US008371267B2

(12) United States Patent
Kristen et al.

(10) Patent No.: US 8,371,267 B2
(45) Date of Patent: Feb. 12, 2013

(54) FUEL INJECTION SYSTEM FOR AN INTERNAL COMBUSTION ENGINE

(75) Inventors: Marcus Kristen, Eberdingen (DE); Achim Koehler, Ditzingen (DE); Sascha Ambrock, Modugno (DE); Walter Fuchs, Stuttgart (DE); Dietmar Ottenbacher, Holzgerlingen (DE); Bertram Schweitzer, Esslingen (DE); Christian Langenbach, Affalterbach (DE); Joerg Wuerz, Stuttgart (DE); Saban Akmese, Witten (DE); Marco Lamm, Modugno (DE); Karl-Heinz Traub, Wiesensteig (DE)

(73) Assignee: Robert Bosch GmbH, Stuttgart (DE)

( * ) Notice: Subject to any disclaimer, the term of this patent is extended or adjusted under 35 U.S.C. 154(b) by 1246 days.

(21) Appl. No.: 11/912,226

(22) PCT Filed: May 8, 2006

(86) PCT No.: PCT/EP2006/062119

§ 371 (c)(1),
(2), (4) Date: Oct. 22, 2007

(87) PCT Pub. No.: WO2006/134002

PCT Pub. Date: Dec. 21, 2006

(65) Prior Publication Data

US 2012/0132177 A1 May 31, 2012

(30) Foreign Application Priority Data

Jun. 16, 2005 (DE) ..... 10 2005 027 851

(51) Int. Cl.
*F02M 37/04* (2006.01)

(52) U.S. Cl. ..... 123/446; 123/514

(58) Field of Classification Search ..... 123/446, 123/447, 510, 511, 514; 417/255
See application file for complete search history.

(56) References Cited

U.S. PATENT DOCUMENTS

| | | | | |
|---|---|---|---|---|
| 5,937,734 | A * | 8/1999 | Stiefel et al. | 92/129 |
| 6,007,311 | A * | 12/1999 | Cygnor et al. | 417/405 |
| 6,722,857 | B1 | 4/2004 | Kellner et al. | |
| 6,722,864 | B2 * | 4/2004 | Suzuki et al. | 417/470 |
| 6,729,309 | B2 * | 5/2004 | Schueler | 123/514 |
| 6,792,915 | B2 * | 9/2004 | Rembold et al. | 123/446 |
| 6,889,665 | B2 * | 5/2005 | Rembold | 123/509 |
| 7,207,319 | B2 * | 4/2007 | Utsumi | 123/446 |
| 7,594,499 | B2 * | 9/2009 | Suzuki et al. | 123/446 |
| 8,157,548 | B2 * | 4/2012 | Meier et al. | 417/490 |
| 2003/0037768 | A1 | 2/2003 | Kanne et al. | |
| 2003/0101970 | A1 * | 6/2003 | Utsumi | 123/495 |
| 2004/0007214 | A1 * | 1/2004 | Schmidl et al. | 123/514 |
| 2004/0047746 | A1 * | 3/2004 | Rembold | 417/273 |
| 2004/0179950 | A1 | 9/2004 | Kuroda | |
| 2004/0197216 | A1 * | 10/2004 | Kuroda | 417/470 |
| 2006/0169251 | A1 * | 8/2006 | Mori et al. | 123/446 |
| 2010/0068079 | A1 * | 3/2010 | Meier et al. | 417/321 |

FOREIGN PATENT DOCUMENTS

| | | | |
|---|---|---|---|
| DE | 10139055 | A1 | 2/2003 |
| EP | 1184568 | A2 | 3/2002 |
| EP | 1296060 | A2 | 3/2003 |
| EP | 1457667 | A1 | 9/2004 |
| WO | 0077389 | A1 | 12/2000 |

* cited by examiner

*Primary Examiner* — Thomas Moulis

(74) *Attorney, Agent, or Firm* — Michael Best & Friedrich LLP

(57) ABSTRACT

The invention relates to a high-pressure fuel pump comprising a drive shaft supported by bearings, and fuel flows through the bearings in a forced manner in such a way that the mechanical and thermal load-carrying capacity of the bearings, and thus the entire high-pressure fuel pump, is significantly increased.

14 Claims, 7 Drawing Sheets

FUEL INJECTION SYSTEM FOR AN INTERNAL COMBUSTION ENGINE

CROSS-REFERENCE TO RELATED APPLICATION

This application is a 35 USC 371 application of PCT/EP 2006/062119 filed on May 8, 2006.

BACKGROUND OF THE INVENTION

1. Field of the Invention

The invention is based on a high-pressure fuel pump for a fuel injection system of an internal combustion engine, and more particularly to such a pump having a pump housing in which a drive shaft is supported by a first bearing and a second bearing; having at least one pump element disposed radially relative to the drive shaft; having a fuel feed line, with a prefeed pump that pumps fuel into the fuel feed line; having a fuel return line; having a metering unit for regulating the pump capacity of the pump element or elements; and having a pressure regulating valve.

2. Description of the Prior Art

In these high-pressure fuel pumps known from the prior art, the pressure regulating valve serves to regulate the pressure in the low-pressure circuit of the high-pressure fuel pump. The pump capacity of the prefeed pump is typically split into three partial flows. A first partial flow flows through the metering unit to the intake side of the pump element or elements. The second partial flow as a rule flows through the pump housing via a lubricating throttle restriction and serves there to cool and lubricate the pump. From the pump housing, the second partial flow reaches the fuel return line of the fuel injection system. A third partial flow flows through the pressure regulating valve, which may also be embodied as an overflow valve, and likewise reaches the fuel return line.

With increasing injection pressures, the mechanical and thermal loads on both the drive shaft and the bearing of the drive shaft in the pump housing also increase. Conventional high-pressure fuel pumps are not capable of withstanding these increasing loads.

The object of the invention is to furnish a high-pressure fuel pump for a fuel injection system that makes do with the same installation space as conventional high-pressure fuel pumps and nevertheless is superior with regard to thermal and mechanical bearing capacity, to the high-pressure fuel pumps known from the prior art. Moreover, the high-pressure fuel pump of the invention should be simple in construction and capable of being produced economically.

In a high-pressure fuel pump for a fuel injection system of an internal combustion engine, having a pump housing, having a drive shaft with the drive shaft supported in the pump housing by a first bearing and a second bearing, having at least one pump element disposed radially relative to the drive shaft, having a fuel feed line, where a prefeed pump pumps fuel into the fuel feed line, having a fuel return line, having a metering unit for regulating the pump capacity of the pump element or elements, and having a pressure regulating valve, this object is attained in that the pressure regulating valve is disposed in the fuel return line.

SUMMARY AND ADVANTAGES OF THE INVENTION

Because according to the invention the pressure regulating valve is disposed in the fuel return line, it is attained among other advantages that the majority of the fuel pumped by the prefeed pump flows through the pump housing and as a result contributes to improved cooling of the pump housing and of the drive shaft. Moreover, the pressure in the pump housing is elevated compared to conventional constructions, which reduces the tendency to cavitation in the interior of the pump housing. Finally, the formation of vapor bubbles and local overheating (so-called hot spots) is effectively prevented.

In the high-pressure fuel pump of the invention, a lubricating throttle restriction between the prefeed pump and the pump housing can be dispensed with, so that despite the advantages cited, the high-pressure fuel pump of the invention is constructed even more simply than conventional high-pressure fuel pumps.

In an advantageous embodiment of the invention, it is provided that the first bearing is lubricated by fuel under pressure; and that the first bearing is in hydraulic communication with both the fuel feed line and the fuel return line. This means that on one side of the first bearing, approximately the same pressure prevails as on the compression side of the prefeed pump, while the other side of the first bearing is in pressure equilibrium with the virtually pressureless fuel return line. As a result, the first bearing necessarily experiences a flow through it of fuel, and thus adequate lubrication and cooling of the first bearing is assured at all operating points.

In a further advantageous feature of the invention, a first flow limiting device is provided, which is connected in series with the first bearing.

The first flow limiting device serves to keep the fuel flow, which flows through the first bearing, within predetermined limits. In mass production of high-pressure fuel pumps, it can happen, because of production variations and wear at the first bearing, that the thickness of the lubrication gap and hence the fuel flow through the bearing and its bearing capacity will vary within very wide limits. This means that if the tolerance situation is unfavorable, the bearing capacity of the first bearing and its cooling and lubrication by the fuel are not adequate at all operating points. If the first flow limiting device according to the invention is now connected in series with the first bearing, it is possible because of the very narrow production tolerance with which the first flow limiting device can be produced to adjust the fuel flow by means of the first bearing. As a result, the aforementioned production variations have only a slight effect on the bearing capacity, so that even given an unfavorable tolerance situation, the bearing capacity of the first bearing is assured at all operating points of the high-pressure fuel pump.

The flow limiting device limits the fuel flow that flows through the bearing. As a result, in unfavorable tolerance situations of the bearing, the demands made of the prefeed pump are reduced.

The object stated at the outset is attained, in a high-pressure fuel pump for a fuel injection system of an internal combustion engine, having a pump housing, having a drive shaft with the drive shaft supported in the pump housing by a first bearing and a second bearing, having at least one pump element disposed radially relative to the drive shaft, having a fuel feed line, where a prefeed pump pumps fuel into the fuel feed line, having a fuel return line, having a metering unit for regulating the pump capacity of the pump element or elements, and having a pressure regulating valve, in that the first bearing is lubricated by fuel under pressure; that the first bearing is in hydraulic communication with both the fuel feed line and the fuel return line; a first flow limiting device is provided; that the first flow limiting device is connected in series with the first bearing; and that between the pump housing and the fuel return line, a bypass throttle restriction is provided.

In this exemplary embodiment of a high-pressure fuel pump of the invention, it is possible by the suitable adaptation of the first flow limiting device and the bypass throttle restriction to assure in a simple and effective way that an adequate quantity of fuel will flow through the first bearing, thus assuring the cooling and lubrication of this bearing at all operating points.

In the high-pressure fuel pumps of the invention, the metering unit can alternatively be disposed either between the prefeed pump and the high-pressure fuel pump in the fuel feed line, or between the pressure regulating valve and the high-pressure fuel pump in the fuel return line. Both arrangements have specific advantages, which should be weighed against one another in an individual case.

A factor in favor of disposing the metering unit between the prefeed pump and the high-pressure fuel pump in the fuel feed line is that with this arrangement, the fuel flowing into the high-pressure region of the high-pressure fuel pump will not have first flowed through the pump housing, so that any chips or other particles may be present there cannot get into the high-pressure fuel region.

An advantage of disposing the metering unit in the fuel return line is that the entire fuel quantity pumped by the prefeed pump is available at every operating point for cooling and lubricating the pump housing or the drive shaft of the high-pressure fuel pump as well as the associated bearings. As a result, the bearing capacity of the low-pressure region of the high-pressure fuel pump of the invention is increased still further.

Alternatively, it is possible to dispose the first flow limiting device either upstream or downstream of the first bearing. Which disposition will be preferred in an individual case depends on the circumstances and peripheral conditions of the individual case.

In a further augmentation of the high-pressure fuel pumps of the invention, it may furthermore be provided that the second bearing is lubricated by fuel under pressure, and that the second bearing is in hydraulic communication with both the fuel feed line and the fuel return line.

Moreover, a second flow limiting device may be provided, which is disposed upstream or downstream of the second bearing. The advantages of the forced lubrication of the second bearing and of the second flow limiting device correspond essentially to the advantages mentioned above, in conjunction with the first bearing and the first flow limiting device.

The first flow limiting device and/or the second flow limiting device may be embodied as a throttle restriction, diaphragm, or flow regulating valve. Which of these alternatives will be preferred in the individual case depends on the ranges of tolerance of the various components, the loads, and of course commercial reasons and must be decided in the individual case.

An especially advantageous feature of the invention provides that the second bearing is supplied with fuel under pressure by a leak fuel line of the prefeed pump. This is especially advantageous whenever the prefeed pump is embodied for instance as a vane cell pump, external gear-wheel pump, or internal gear-wheel pump. In vane cell pumps or gear pumps, leakage that must be carried away through a leak fuel line occurs at the interface with the drive shaft, in the gap between the vane wheel or gear wheel and the housing. If this leak fuel line is now used for lubricating and cooling the second bearing, then firstly the lubrication and cooling of the second bearing can be assured under all operating conditions, and secondly, because of the counterpressure, the leak fuel quantity from the prefeed pump is reduced. This leads to improved hydraulic efficiency of the prefeed pump.

It is especially advantageous if the first bearing and/or the second bearing is embodied as a slide bearing. Then, by the provision according to the invention of fuel under pressure to the bearing, a stable hydrostatic film of lubrication is formed, which assures a very high bearing capacity of the bearings in the most various rpm ranges.

Advantageously, the fuel connection discharges into an interior of the pump housing.

BRIEF DESCRIPTION OF THE DRAWINGS

Further advantages and advantageous features of the invention can be learned from the description contained herein below, taken in conjunction with the drawings, in which.

DESCRIPTION OF THE PREFERRED EMBODIMENTS

Figure 1:
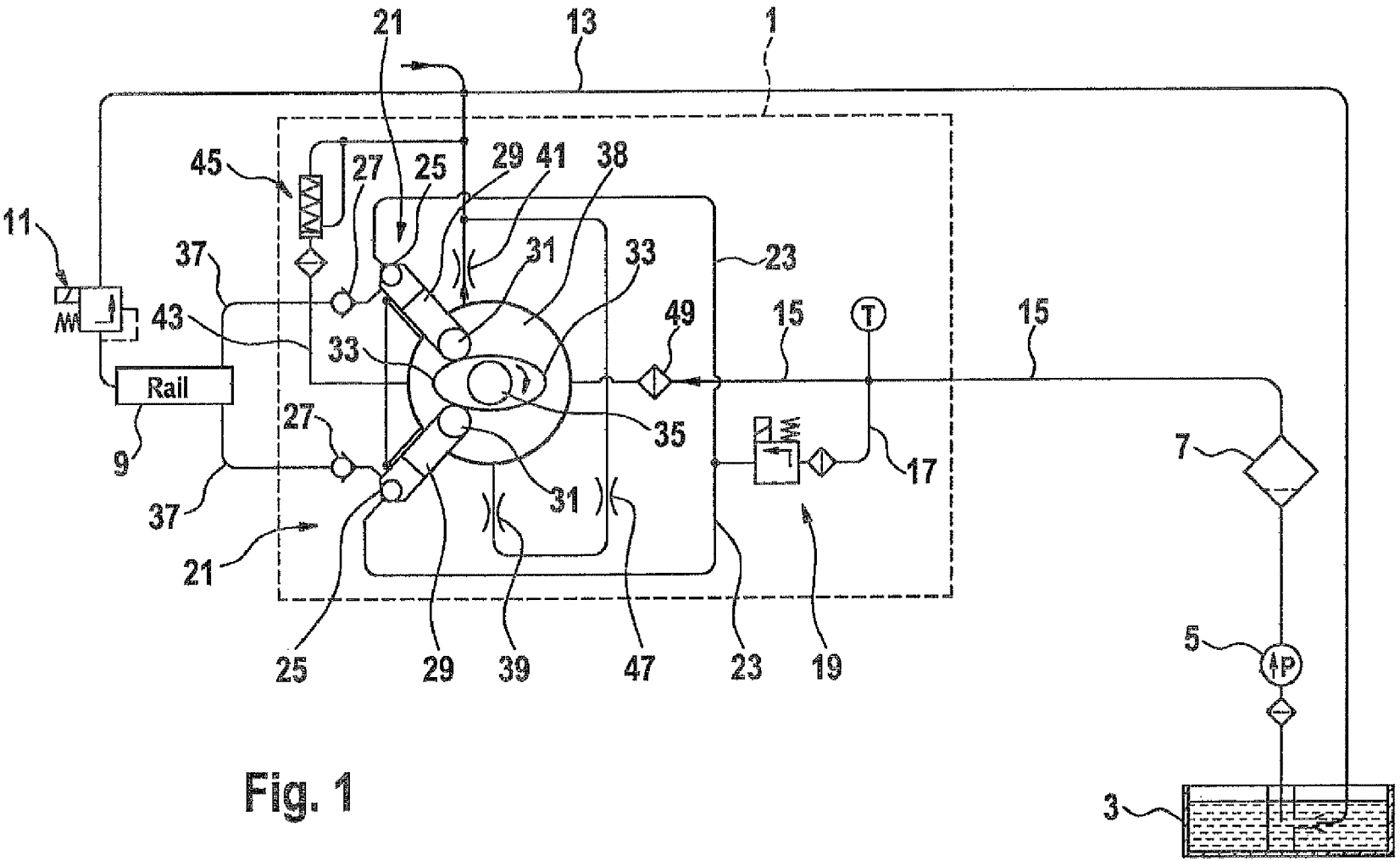
FIG. 1 shows a first exemplary embodiment of a high-pressure fuel pump 1 of the invention in a block circuit diagram and FIGS. 2 through 7 are views similar to FIG. 1 showing alternative embodiments of the Invention.

The high-pressure fuel pump 1 is part of a fuel injection system that essentially comprises a tank 3, a prefeed pump 5, a filter 7, a rail 9, and a pressure limiting valve 11. The injectors, which are connected to the rail 9, are not shown in the drawings. The pressure limiting valve 11 discharges into a return line 13, into which the leak fuel quantities from the injectors are also carried away. The return line 13, in this first exemplary embodiment, discharges into the tank 3, where it drives a jet pump (not identifiedby reference numeral).

In the interior of the high-pressure fuel pump 1, there is a temperature sensor T. The high-pressure fuel pump 1 communicates hydraulically with the tank 3 via a fuel feed line 15, the filter 7, and the prefeed pump 5.

Inside the high-pressure fuel pump 1, a first branch line 17, in which a metering unit 19 is disposed, branches off from the fuel feed line 15. The metering unit 19 serves to control the quantity of fuel aspirated by pump elements 21 of the high-pressure fuel pump, and thus also to control the pump capacity thereof. To that end, the intake sides of the pump elements 21 communicate hydraulically with the outlet of the metering unit 19 via a distribution line 23.

The pump elements 21 essentially comprise suction valves 25, check valves 27 on the high-pressure side, and a piston 29 that oscillates in a cylinder bore (not identified by reference numeral). The pistons 29 of the pump elements 21 are driven via roller tappets 31 by cams 33 of a drive shaft 35. The pump elements 21 pump fuel, which is at high pressure, into the rail 9 via a high-pressure line 37.

The cams 33 are part of a drive shaft 35 that is supported rotatably on both sides of the cams 33 in a first bearing and in a second bearing in a pump housing (not shown). The drive shaft 35 is disposed in the interior 38 of the pump housing. The bearings of the drive shaft 35 are shown as throttle restrictions in the block circuit diagram in FIG. 1. In FIG. 1, the first bearing is identified by reference numeral 39, while the second bearing has been provided with reference numeral 41.

A fuel return line 43 acts as a hydraulic communication between the interior 38 of the pump housing and the return line 13. A pressure regulating valve 45 is disposed in the fuel return line 43. Various throttle restrictions (not shown) may be integrated with the pressure regulating valve 45.

In the exemplary embodiment, shown in FIG. 1, of a high-pressure fuel pump according to the invention, the pressure regulating valve 45 is disposed downstream of the interior 38 of the high-pressure fuel pump 1. This means that in the interior 38, virtually the same pressure as on the compression side of the prefeed pump 5 prevails. As a rule, the pressure on the compression side of the prefeed pump 5 and thus in the interior 38 amounts to approximately 3 bar to approximately 6 bar.

This pressure prevailing in the interior 38 leads to a lessening of the tendency to cavitation, and thus to suppression of vapor bubbles, especially at high rotary speeds. Moreover, the elevated internal pressure in the interior 38 of the pump housing causes fuel to be forced through the first bearing 39 and the second bearing 41. As a result, depending on the pressure prevailing in the interior 38, the viscosity of the fuel, and the flow resistance of the first bearing 39 and the second bearing 41, a defined quantity of fuel is forced through the bearings 39 and 41. This leads to a marked increase in the bearing capacity of both the first bearing 39 and the second bearing 41.

Since the first bearing 39 and the second bearing 41 are as a rule embodied as slide bearings, the forced flow through the bearings 39 and 41 leads to the development of a hydrostatic lubrication wedge in the bearings 39 and/or 41. As a result, the bearing capacity of the first bearing 39 and second bearing 41 increases considerably, and at the same time the heat dissipation from the first bearing 39 and the second bearing 41 is improved.

To reduce the variation in the fuel quantity that flows through the first bearing 39, and thus also to reduce the variation in the bearing capacity of the first bearing, a first optional flow limiting device 47 is disposed in series with the first bearing 39. This first flow limiting device may, as indicated in FIG. 1, be embodied as a throttle restriction. Alternatively, it may be embodied as a diaphragm or as a flow regulating valve.

In experiments, it has been found that because of the production tolerances, for instance in the diameter of the bearing journal (not shown) of the drive shaft 35 for the first bearing 39 and the associated bearing plate (not shown) in the pump housing, given an unfavorable tolerance situation, the quantity of fuel that flows through the first bearing 39 can vary considerably within one series of high-pressure fuel pumps 1. This unwanted effect is reduced, if necessary, to a non-critical amount by the first flow limiting device 47 according to the invention.

Because of the serial connection of the first bearing 39 and the first flow limiting device, it can be assured that the quantity of fuel that flows through the first bearing 39 can be kept within a relatively narrow range. This can be ascribed above all to the fact that the flow resistance of the first flow limiting device 47 can be adjusted with very high precision. By a suitable adaptation of the flow resistance of the first flow limiting device 47 and the pressure prevailing in the interior 38, it is possible in the high-pressure fuel pump 1 of the invention to keep the fuel quantity flowing through the first bearing 39 within a predetermined range under all tolerance conditions that occur in mass production.

If needed, a suitable second flow limiting device (not shown) may also be provided for the second bearing 41.

In FIG. 1, a filter is provided in the fuel feed line 15; this filter also takes on the function of a damping device 49. Thus any pressure fluctuations in the low-pressure region can be damped. Alternatively, the damping device 49 may be embodied with a gas cushion, or may be omitted.

The high-pressure fuel pump 1 of the invention has the following advantages, among others:

Because of the disposition of the pressure regulating valve 45 in the fuel return line 43, the pressure level prevailing in the interior 38 of the pump housing is increased, which reduces the danger of cavitation and the danger of vapor bubble formation.

Moreover, both the first bearing 39 and the second bearing 41 as a result necessarily experience a flow through them of fuel, which markedly increases their bearing capacity with regard to both mechanical and thermal stresses.

Any fluctuations in the flow quantity that may occur between various examples of mass-produced high-pressure fuel pumps 1 according to the invention can be reduced by means of a series-connected first flow limiting device 47 and/or a second flow limiting device.

The quantity of fuel flowing through the pump housing and the bearings 39 and 41 for lubricating and cooling purposes is increased sharply.

A lubricating throttle restriction for adjusting a defined quantity of lubricant can be omitted. Because of the high lubrication quantities, any particles that may be present are rapidly floated out of the interior.

The pumping capacity of the prefeed pump can often be reduced, which improves the efficiency of the injection system.

In FIGS. 2 through 7 further exemplary embodiments of high-pressure fuel pumps according to the invention and fuel injection systems according to the invention are shown, also in the form of block circuit diagrams. Only the essential differences will now be explained. Identical components are provided with the same reference numerals, and what has been said for the exemplary embodiment above applies accordingly. In FIGS. 2 through 7, for the sake of simplicity, not all the components are provided with the reference numerals of FIG. 1, and with respect to these components, reference is made to what is said in conjunction with the first exemplary embodiment.

Figure 2:
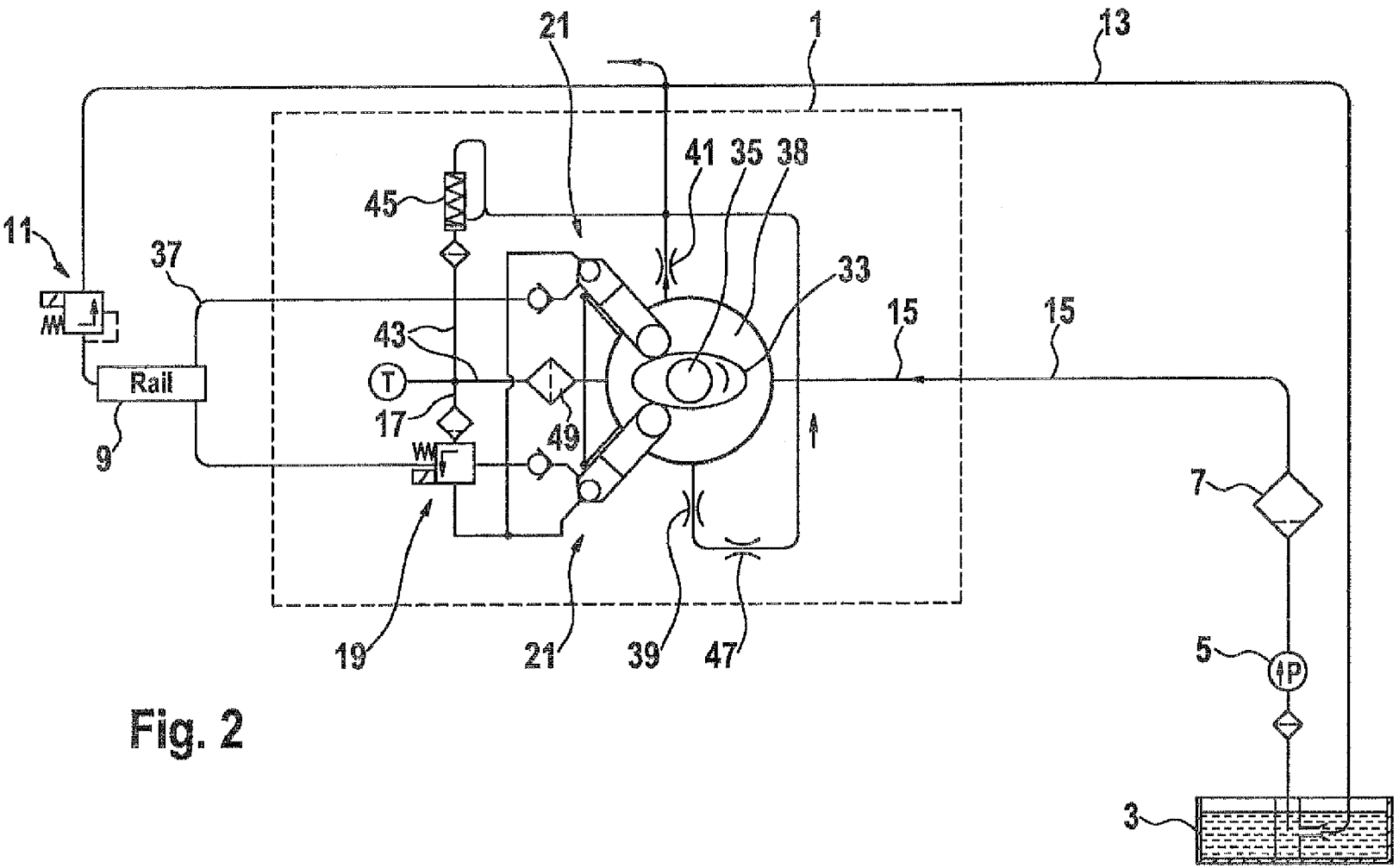

The essential distinction between the first exemplary embodiment of FIG. 1 and the second exemplary embodiment of FIG. 2 is that the first branch line 17 in the second exemplary embodiment branches off from the fuel return line 43. This means that the entire amount of fuel pumped by the prefeed pump 5 through the fuel feed line 15 reaches the interior 38 of the high-pressure fuel pump first and branches off only after that. As a result, an even better flow through the high-pressure fuel pump 1 and even better pump cooling are attained.

To damp any pressure fluctuations that occur in the low-pressure region, a damping device 49 is provided in the fuel return line 43. The damping device 49 is disposed upstream of the pressure regulating valve 45 and the metering unit 19. In FIG. 2, the damping device 49 is embodied as a filter with an increased flow resistance if needed (not shown). Alternatively, the damping device 49 may be embodied as a damper with a gas cushion.

Figure 3:
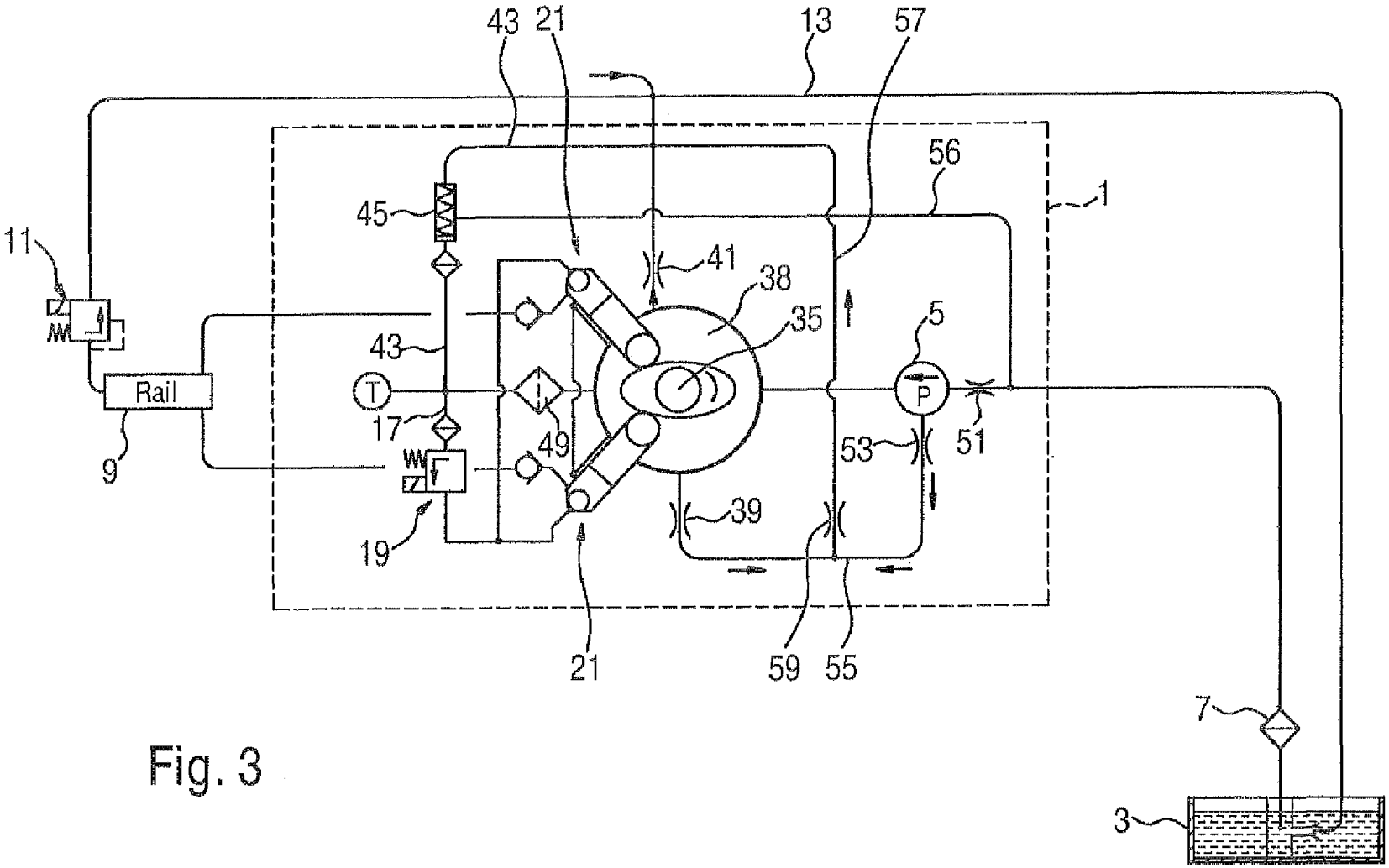

The third exemplary embodiment in FIG. 3 corresponds in wide areas to the second exemplary embodiment of FIG. 2. An essential distinction is that, unlike in the preceding exemplary embodiments, the prefeed pump 5 is driven not by an electric motor (not shown) but rather directly by the engine. The details of this drive mechanism are not shown in FIG. 3.

Upstream of the prefeed pump 5, namely between the filter 7 and the prefeed pump 5, a suction throttle restriction 51 is provided, which limits the pump capacity of the prefeed pump 5, above all at high rotary speeds.

The prefeed pump 5 may be embodied as a vane cell pump, external gear-wheel pump or internal gear-wheel pump, and in particular as a Gerotor pump. In these pumps, there is a gap that causes leakage losses between the rotating components and the pump housing. This gap is represented in FIG. 3 by the symbol for a throttle restriction (see reference numeral 53).

The leak fuel quantity flowing out through the gap is carried away through a leak fuel line 55.

In the third exemplary embodiment, a diversion line 56 is provided, which begins at the pressure regulating valve 45 and discharges into the fuel feed line 15 upstream of the suction throttle restriction 51. Via the diversion line 56, the excess fuel quantity from the pressure regulation is carried away into the feed line 15.

The first bearing 39 is supplied with fuel from the interior 38. From the leak fuel line 55, a second branch line 57 branches off, which discharges into the fuel return line 43. Through the second branch line 57, the quantity of lubricant in the first bearing 39 is also carried away. A bypass throttle restriction 59 may be provided in the second branch line 57.

Figure 4:
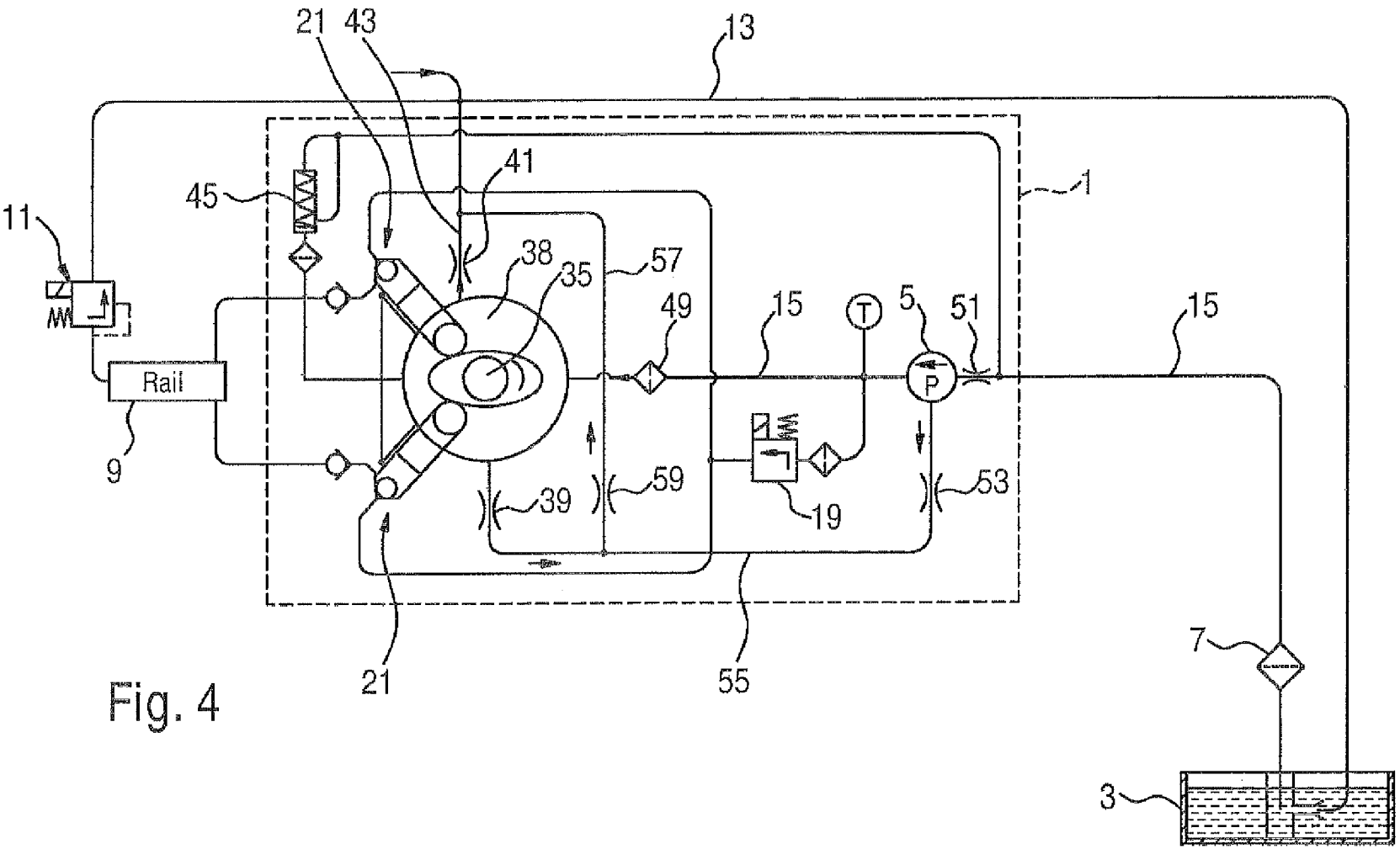

In FIG. 4, fourth exemplary embodiment of a high-pressure fuel pump 1 of the invention is shown that has many parallels with the third exemplary embodiment of FIG. 3. In this exemplary embodiment as well, a leak fuel line 55 is located at the prefeed pump 5.

In this exemplary embodiment as well, the first bearing 39 is supplied with fuel from the interior 38. From the leak fuel line 55, a second branch line 57 branches off, which discharges into the fuel return line 43. Through the second branch line 57, the quantity of lubricant in the first bearing 39 is also carried away. A bypass throttle restriction 59 may be provided in the second branch line 57. In this exemplary embodiment, the metering unit 19 is disposed in the fuel feed line 15, as is also the case in the first exemplary embodiment of FIG. 1.

In the exemplary embodiment of FIG. 4, the fuel return line 43 is returned not to the tank 3, as in the exemplary embodiments of F*igs*. 1 and 2, but rather into the fuel return line 15 as in the third exemplary embodiment, specifically upstream of the suction throttle restriction 51.

Figure 5:
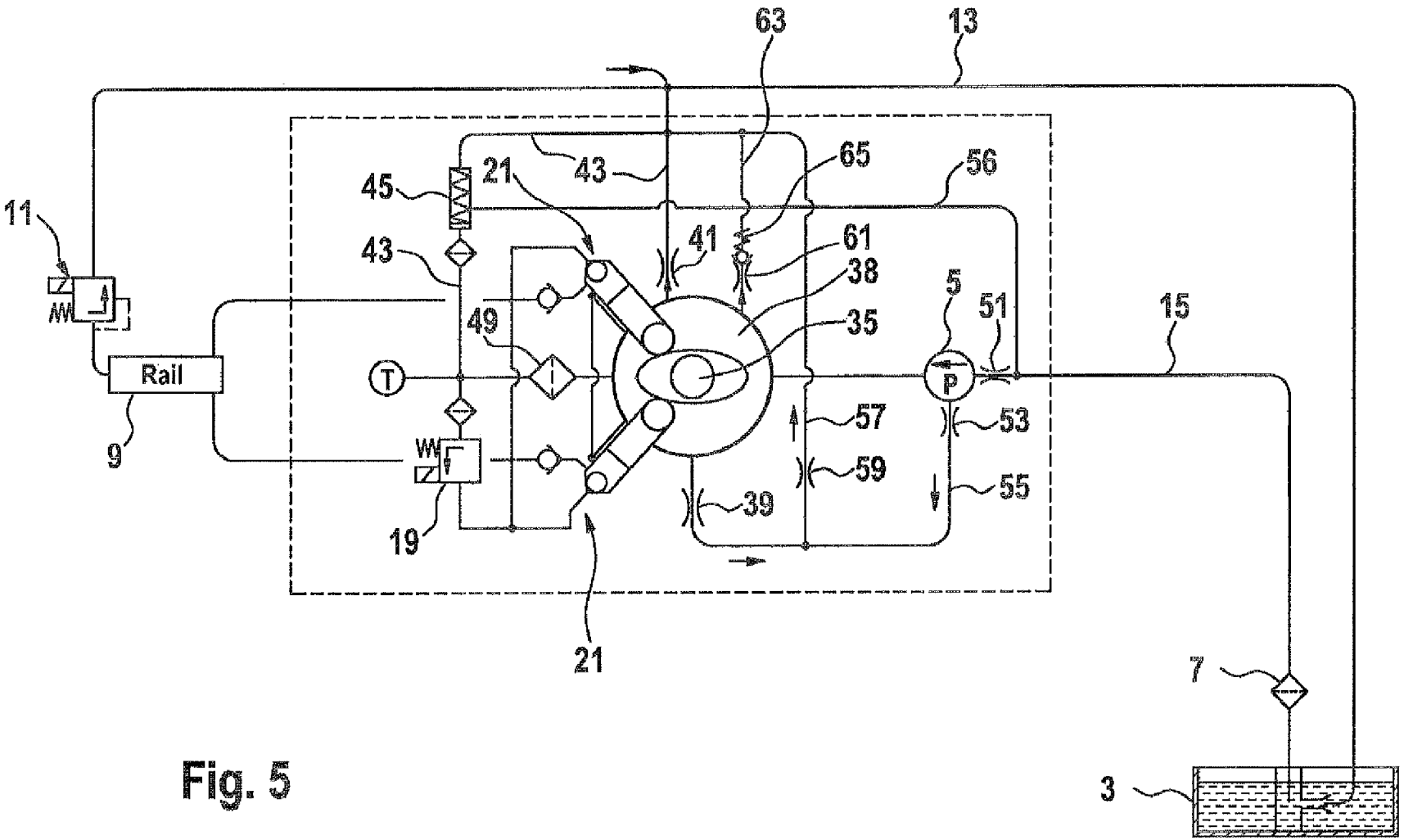

The essential distinction of the fifth exemplary embodiment of FIG. 5 compared with the fourth exemplary embodiment of FIG. 4 is that in the fifth exemplary embodiment, the metering unit 19 and the optional damping device 49 are disposed in the fuel return line 43. The pressure relief for the motion of the piston of the pressure regulating valve 45 can be selectively connected into the fuel feed line 15 or the fuel return line 43.

In addition, the pressure regulating valve 45 has a separate diversion line 56, which, similarly to the third exemplary embodiment, discharges into the fuel feed line 15 upstream of the suction throttle restriction 51.

In this exemplary embodiment, the fuel return line 43 is returned to the tank 3 via the return line 13. In a third branch line 63, which connects the interior 38 of the high-pressure fuel pump 1 to the fuel return line 43, there is a second bypass throttle restriction 61. In series with the second bypass throttle restriction 61, a pressure limiting valve 65 is also provided in the third branch line 63. The pressure limiting valve 65 assures that if a predetermined pressure difference between the pressure in the interior 38 of the high-pressure fuel pump 1 and the fuel return line 43 is exceeded, the third branch line 63 is opened, and thus the excess fuel can flow out of the interior 38.

Figure 6:
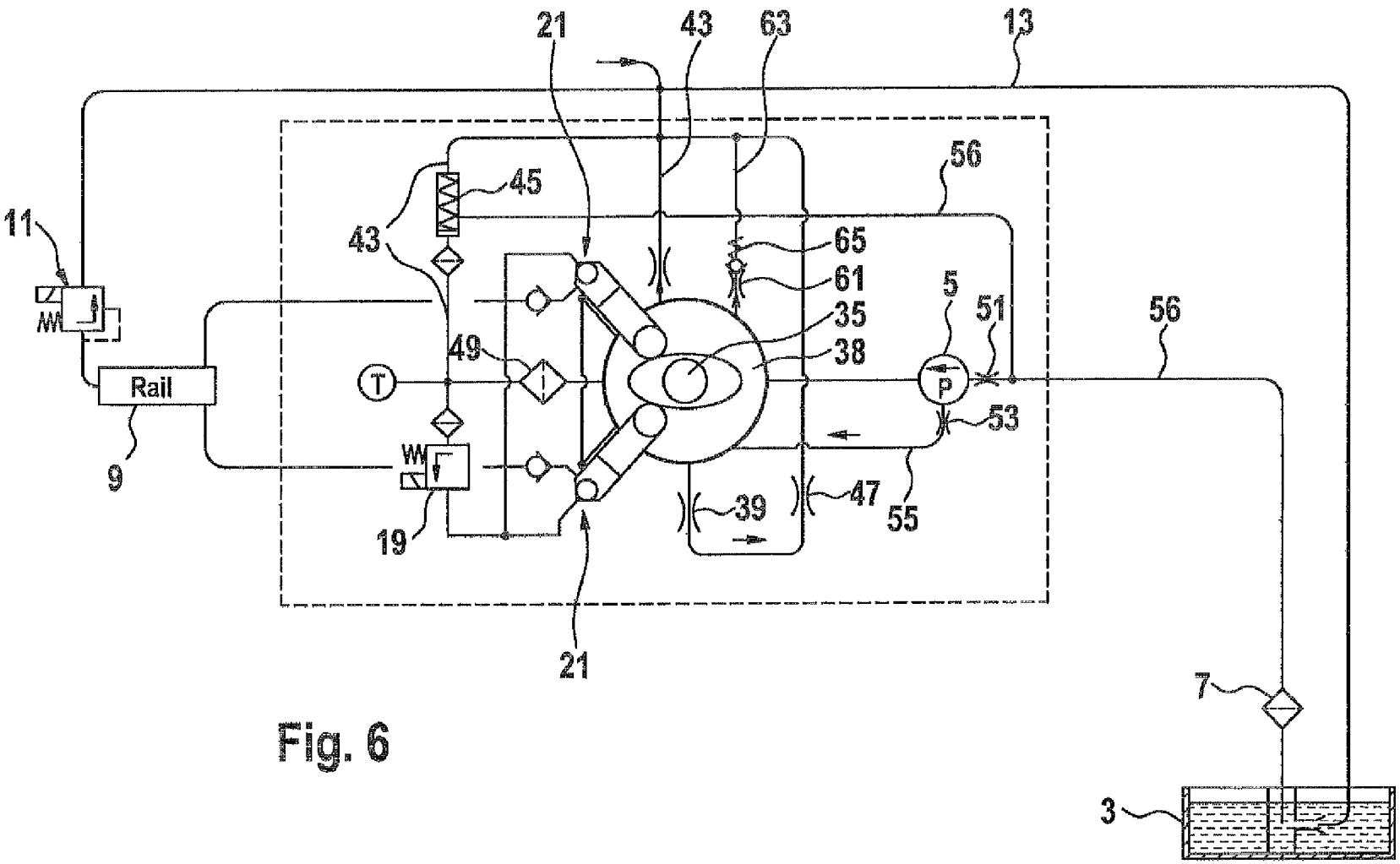

In the sixth exemplary embodiment of FIG. 6, the leak fuel line 55 discharges into the interior 38 of the pump housing. The first bearing 39 is supplied with fuel under pressure from the interior 38 of the pump housing, and this fuel then flows through the first flow limiting device 47 and then reaches the fuel return line 43. In this exemplary embodiment as well, the fuel metering unit 19 is disposed on the side toward the fuel return line 43, with the advantages already mentioned several times; however, it may also be disposed on the side of the fuel feed line 15.

Figure 7:
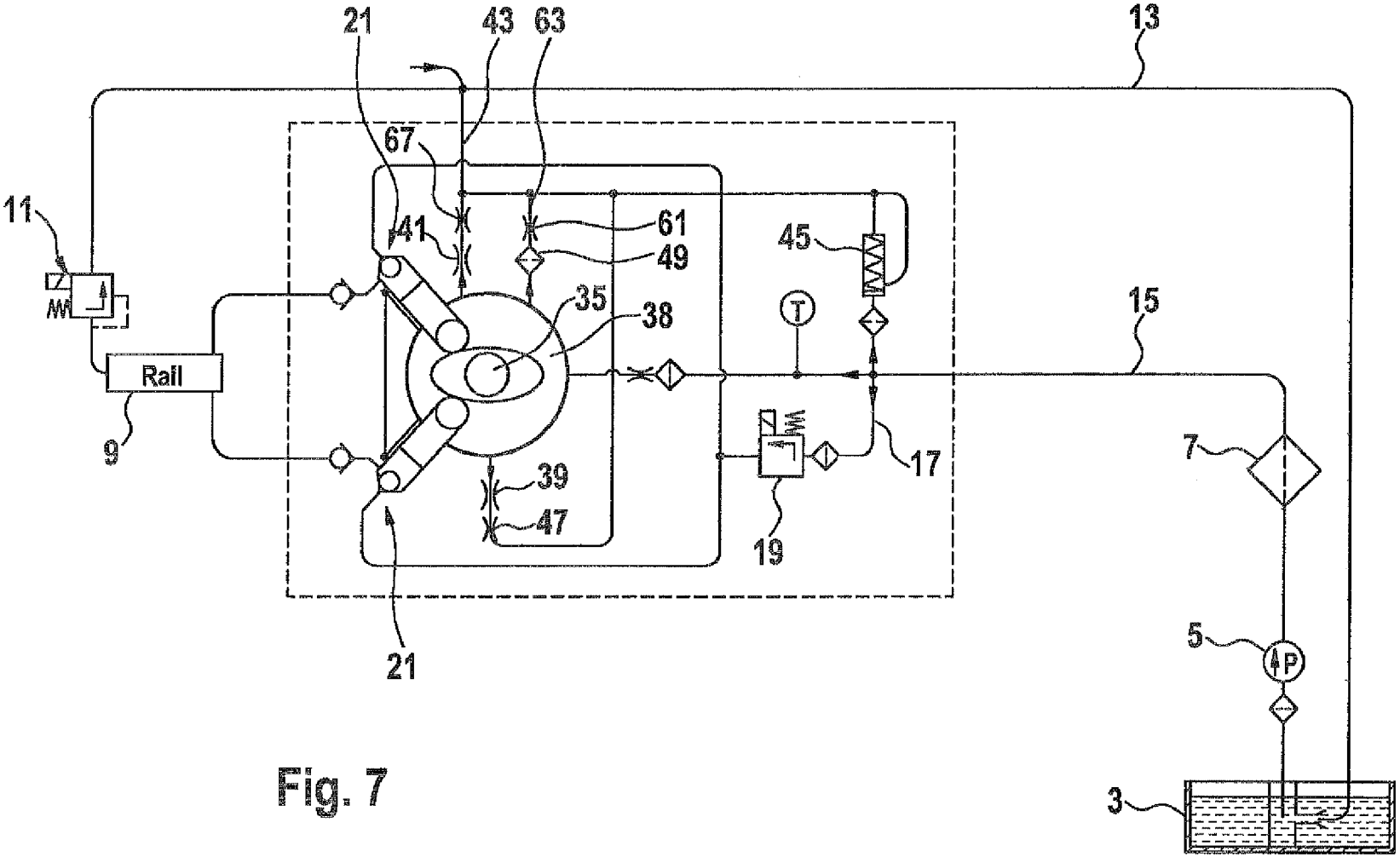

In the exemplary embodiment of FIG. 7, the prefeed pump 5 is embodied as a fuel pump which is driven by an electric motor and is disposed in the vicinity of the tank 3. The metering unit 19 is disposed on the fuel feed line side 15 of the high-pressure fuel pump 1. The pressure regulating valve 45 is connected on the inlet side to the fuel feed line 15. The outlet side of the pressure regulating valve 45 discharges into the fuel return line 43. Also discharging into the fuel return line 43 is the third branch line 63, in which there is not only a second bypass throttle restriction but also a damping device 49, such as filter. Also in the fuel return line 43, the fuel that flows through the first bearing 39 and the first flow limiting device 47 is carried away. The same applies to the second bearing 41, which in the exemplary embodiment of FIG. 7 is provided with a second flow limiting device 67, whose mode of operation corresponds to that of the first flow limiting device 47.

The foregoing relates to a preferred exemplary embodiment of the invention, it being understood that other variants and embodiments thereof are possible within the spirit and scope of the invention, the latter being defined by the appended claims.

The invention claimed is:

1. A high-pressure fuel pump for a fuel injection system of an internal combustion engine, the pump comprising a pump housing, a drive shaft supported in the pump housing by a first bearing and a second bearing, at least one pump element disposed radially relative to the drive shaft, a fuel feed line receiving fuel from a prefeed pump and leading to the pump housing, a fuel return line draining off from the pump housing to the at least one pump element, a metering unit for regulating the pump capacity of the at least one pump element, a pressure regulating valve disposed in the fuel return line, the metering unit being disposed between the pressure regulating valve and the at least one pump element in the fuel return line, the first bearing being lubricated by fuel under pressure and being in hydraulic communication with both the fuel feed line, via the pump housing, and a return line returning fuel to a fuel tank, and a first flow limiting device connected in series with the first bearing.

2. The high-pressure fuel pump as defined by claim 1, wherein the metering unit is disposed between the pressure regulating valve and the high-pressure fuel pump in the fuel return line.

3. The high-pressure fuel pump as defined by claim 1, wherein the first flow limiting device is disposed upstream or downstream of the first bearing.

4. The high-pressure fuel pump as defined by claim 1, wherein the second bearing is lubricated by fuel under pressure; and wherein the second bearing is in hydraulic communication with both the fuel feed line and the fuel return line.

5. The high-pressure fuel pump as defined by claim 4, further comprising a second flow limiting device, the second flow limiting device being disposed upstream or downstream of the second bearing.

6. The high-pressure fuel pump as defined by claim 5, wherein at least one of the first flow limiting device and the second flow limiting device is embodied as a throttle restriction or diaphragm.

7. The high-pressure fuel pump as defined by claim 5, wherein at least one of the first flow limiting device and the second flow limiting device is embodied as a flow regulating valve.

8. The high-pressure fuel pump as defined by claim 1, wherein the first bearing is lubricated by fuel under pressure; and wherein the first bearing is supplied with fuel under pressure by a leak fuel line of the prefeed pump.

9. The high-pressure fuel pump as defined by claim 1, wherein at least one of the first bearing and the second bearing is embodied as a slide bearing.

10. The high-pressure fuel pump as defined by claim 1, wherein the fuel connection discharges into an interior of the pump housing.

11. A fuel injection system for an internal combustion engine, the system comprising a prefeed pump, a tank, a common rail, at least one injector, and the high-pressure fuel pump as defined by claim 1.

12. The fuel injection system as defined by claim 11, wherein the prefeed pump is driven by the engine.

13. The fuel injection system as defined by claim 11, wherein the prefeed pump is driven by an electric motor.

14. The fuel injection system as defined by claim 11, wherein the prefeed pump is embodied as a vane cell pump.

* * * * *

UNITED STATES PATENT AND TRADEMARK OFFICE

CERTIFICATE OF CORRECTION

PATENT NO. : 8,371,267 B2
APPLICATION NO. : 11/912226
DATED : February 12, 2013
INVENTOR(S) : Kristen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1493 days.

Signed and Sealed this
First Day of September, 2015

Michelle K. Lee

Michelle K. Lee
*Director of the United States Patent and Trademark Office*